United States Patent [19]

Schmermund

[11] 3,956,865

[45] May 18, 1976

[54] METHOD AND APPARATUS FOR PRODUCING A CONTAINER

[76] Inventor: Alfred Schmermund, 62 Kornerstrasse, 5820 Gevelsberg, Germany

[22] Filed: Aug. 8, 1974

[21] Appl. No.: 495,741

[30] Foreign Application Priority Data

Sept. 5, 1973 United Kingdom ..... 41744/73

[52] U.S. Cl. ..... 53/29; 53/148; 53/234; 93/12 C

[51] Int. Cl.[2] ..... B65B 19/20; B65B 43/10

[58] Field of Search ..... 53/29, 148, 207, 192, 53/234; 93/12 C, 44.1 R; 229/44 CB

[56] References Cited

UNITED STATES PATENTS

| | | | |
|---|---|---|---|
| 2,119,058 | 5/1938 | Richardson | 53/29 X |
| 2,874,524 | 2/1959 | Ringler | 53/192 X |
| 2,944,555 | 7/1960 | Peel | 229/44 CB X |
| 3,762,130 | 10/1973 | Davies | 53/207 X |
| 3,802,325 | 4/1974 | Bardenhagen | 93/12 C |
| 3,858,788 | 1/1975 | Phillips | 229/93 CB |

*Primary Examiner*—Travis S. McGehee
*Assistant Examiner*—John Sipos
*Attorney, Agent, or Firm*—Sughrue, Rothwell, Mion, Zinn & Macpeak

[57] ABSTRACT

A method of producing a container, such as a flip-top cigarette packet, is disclosed. The method includes the initial step of folding an elongate blank at a fold line so that first and second portions of the blank on respective opposite sides of the fold line are brought into mutually facing relationship, and the subsequent steps of folding the first such portion to form the main body of the container and folding the second such portion to form the lid of the container, the latter folding step being carried out whilst the lid portion remains hingedly connected with the main body at the fold line. Also disclosed is apparatus comprising respective folding means to perform the three folding operations referred to above.

19 Claims, 45 Drawing Figures

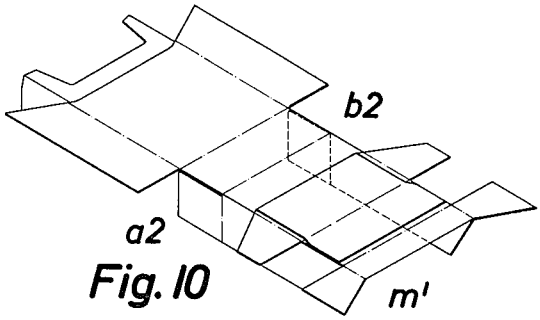
Fig. 10
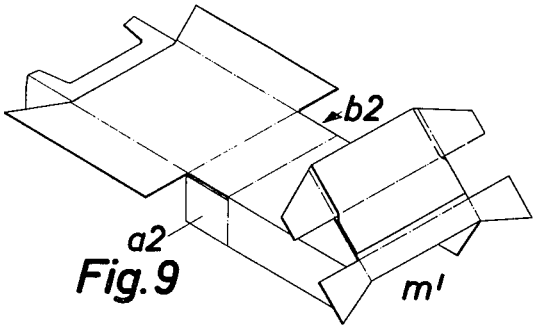
Fig. 9
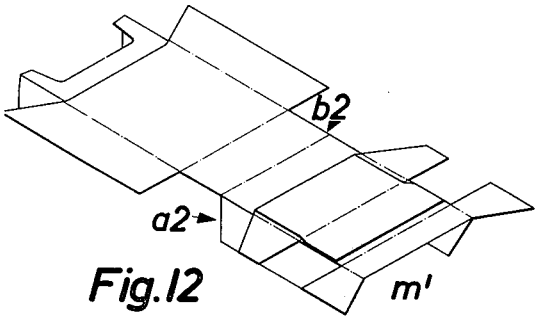
Fig. 12
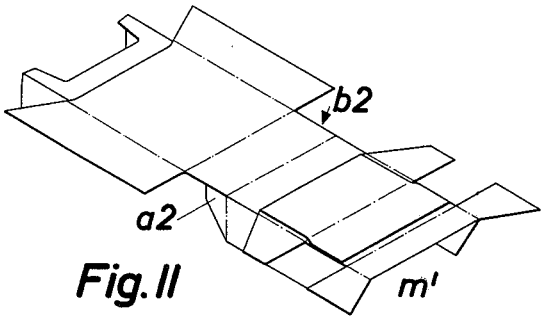
Fig. 11
Fig. 14
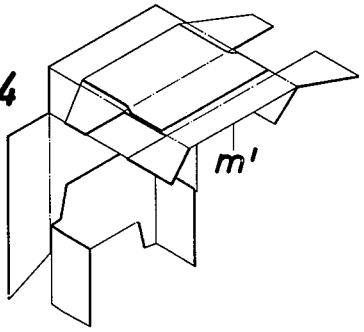
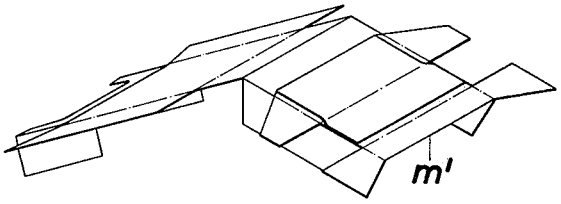
Fig. 13
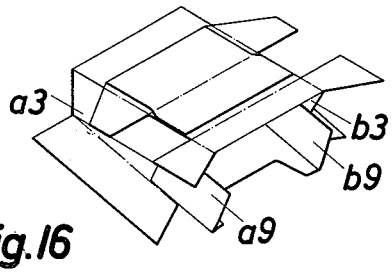
Fig. 16
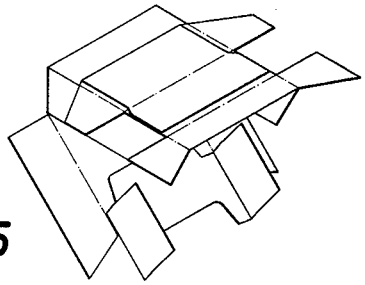
Fig. 15

A-A

B-B

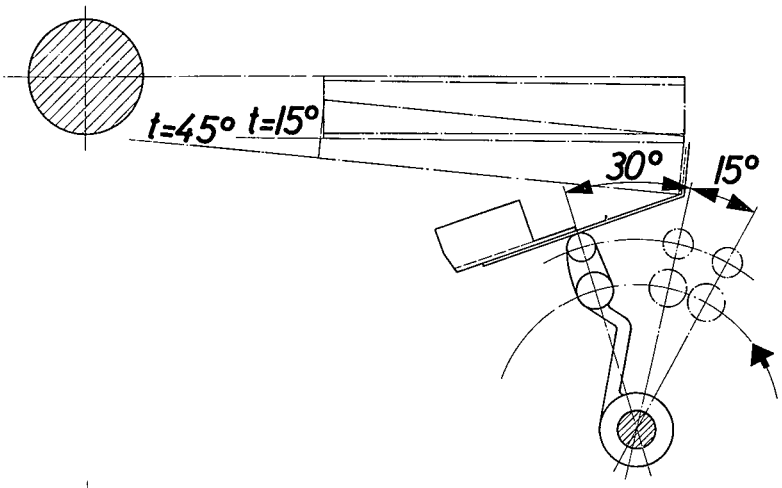
Fig. 35
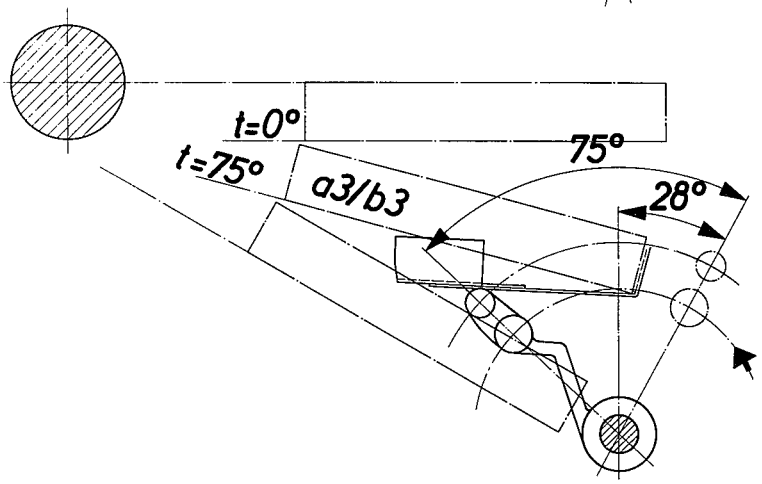
Fig.36
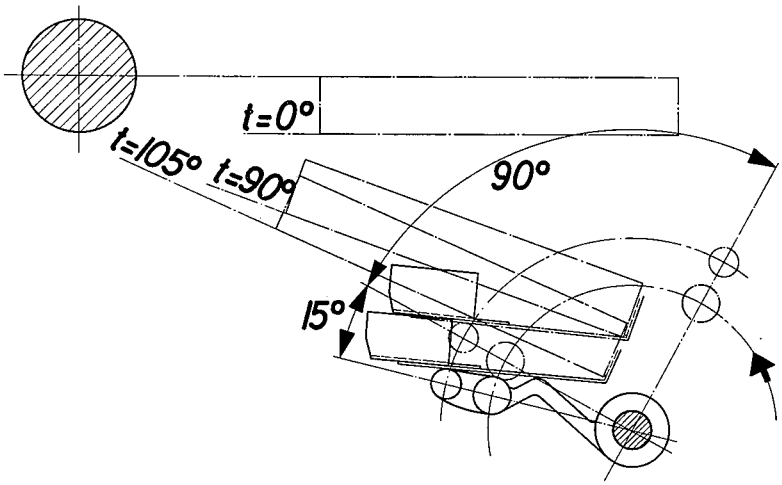
Fig.37
Fig.38
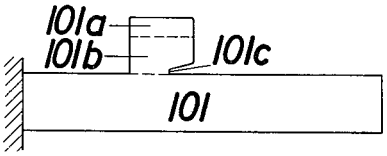
Fig.39
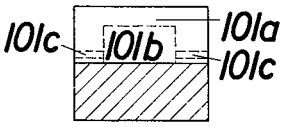

201
202
203
204
205
301
302
237a-b
RI
RII
RIII

METHOD AND APPARATUS FOR PRODUCING A CONTAINER

BACKGROUND OF THE INVENTION

The present invention relates to a method and apparatus for producing a container.

It is known to wrap block-like articles such as cigarettes in a wrapper or container by folding a container blank around the article, e.g. a rectangular block of cigarettes all oriented to be parallel to one another.

SUMMARY OF THE INVENTION

According to one aspect of the present invention, there is provided a method of producing a container, comprising the steps of providing an elongate container blank, which is of foldable material and which has a fold line at the boundary between a first longitudinal portion and a second longitudinal portion of the blank, and folding the blank at the fold line to bring mutually adjacent surface portions of the first portion and of the second portion respectively into mutually facing relation, the method further comprising the subsequent steps of folding the first portion to form a main body of such container, and folding the second portion to form a lid of such container, while the lid remains hingedly connected with the main body at the fold line.

According to a second aspect of the present invention, there is provided an apparatus for carrying out the method defined above, the apparatus comprising first folding means so to fold such blank at the foldline as to bring mutually adjacent surface portions of the first portion and of the second portion respectively into mutually facing relation, second folding means to fold the first portion to form the main body of the container, and third folding means to fold the second portion to form the lid of the container.

The apparatus may comprise a mandrel to support the blank during the operation of the second and third folding means, the mandrel comprising a main portion arranged to co-operate with the second folding means, and a projecting portion, which projects from the main portion and which is arranged to co-operate with the third folding means, the projecting portion defining with the main portion a recess to receive parts adjacent the fold line of the first and of the second portion of the first folding means and being provided with an aperture therethrough, the apparatus further comprising retaining means to extend through the aperture to retain said adjacent parts of the blank when present in the recess, and preferably the first folding means comprise a lever arranged in a first position thereof to be engaged by the second portion of the blank and then to move to a second position to fold the blank at the fold-line, holding means being provided to hold the first portion of the blank in contact with a support during said movement of the lever.

Further preferably, the apparatus comprises displacement means to displace the holding means in a direction towards the projecting portion after said movement of the lever and thereby to cause said adjacent parts of the first and second portions to be introduced into the recess.

The second folding means may include deflecting means to deflect opposite lateral extremities of the first portion of the blank in parallel directions perpendicular to the plane of the blank.

The second folding means may include a folder arranged to co-operate with the mandrel so to fold the first portion of the blank along a line perpendicular to the length direction of the blank, that after the operation of the folder the two parts of the first portion on respective sides of said perpendicular line are inclined at 90° to one another.

Suitably, a plurality of such mandrels are angularly spaced from one another on a folder revolver, the recess of each mandrel being open in a direction radial of the revolver, an individual retaining means being adapted to extend through the aperture of each respective projecting portion, the revolver being selectably actuatable to execute successive angular displacements, and preferably twelve mandrels are provided on the revolver at equal successive angular spacings.

The second folding means may include two spaced guide surfaces of a housing, in which the revolver is so rotatably mounted, that during the successive angular displacements successive mandrels pass between the guide surfaces, and preferably the second folding means include a folding member mounted to be rotable about an axis substantially parallel to the axis of rotation of the revolver, the rotation of the revolver and of the folding member being effected synchronously.

The third folding means may include two folding levers mounted to be pivotable about an axis substantially parallel to the axis of rotation of the revolver, the folding levers being spaced along their axis of pivoting and being displaceable parallel to that axis.

The apparatus may comprise further retaining means to retain a part of the second portion of the blank in contact with the projecting portion, said part being remote from said adjacent parts.

The apparatus may comprise two storage magazines each to receive a plurality of container blanks, and feeding means to feed a container blank selectively from either one of the storage magazines towards the or one such mandrel.

The apparatus may comprise a feeding revolver arranged to feed an individual block-like article towards each respective container succesively produced on the folder revolver, the feeding revolver comprising a plurality of cells spaced about the periphery thereof each to receive a block-like article, the apparatus further comprising displacing means selectably operable to displace two block-like articles each individually into a respective one of two cells of the feeding revolver, means to rotate the feeding revolver stepwise to bring the cells individually and successively to a feeding station, means selectably operable to bring the containers individually and successively to the feeding station, and means selectively operable to transfer the block-like article in the cell at the feeding station into the container at the feeding station, and preferably the feeding revolver is provided with seven cells at equal successive angular spacings.

Suitably, the means to bring the containers to the feeding station comprise a further revolver provided with cells each to receive an individual container, and means to transfer the containers individually from the mandrels to a respective cell of the further revolver, and preferably the further revolver is provided with eight cells at equal successive angular spacings.

The means to displace two block-like articles may comprise two storage cells each pivotable into a position in alignment with a respective one of said two cells on the feeding revolver, and slideable means to push the two block-like articles into said two cells.

According to a third aspect of present invention, there is provided a mandrel for use in the further folding of an elongate container blank folded along a line joining a first and a second longitudinal portion of the blank, the mandrel comprising an elongate main portion to support such first longitudinal portion of such container blank, and a projecting portion, which projects from the main portion and which defines with the main portion a recess to receive parts adjacent the fold line of the first and the second longitudinal portion, the projecting portion being provided with an aperture therethrough to receive retaining means to retain said adjacent parts of the blank when present in the recess, the arrangement being such that while said adjacent parts are received in the recess the first longitudinal portion and the second longitudinal portion of the blank may be folded about the main portion and the projecting portion of the mandrel respectively.

A revolver may comprise a plurality of mandrels as defined above, which are angularly spaced about the periphery of the revolver with the length direction of each main portion disposed radially of the revolver.

Preferably, twelve mandrels are provided at equal successive angular spacings.

According to a fourth aspect of the present invention, there is provided an apparatus for feeding container blanks in succession to a folding device, the apparatus comprising two storage magazines each to receive a plurality of container blanks, and feeding means to feed a container blank selectively from either one of the storage magazines towards output means to feed an input station of such folding device, the feeding means comprising means to apply suction to a container blank when situated in one of the storage magazines.

According to a fifth aspect of the present invention, there is provided an apparatus for feeding block-like articles to a packing station, the apparatus comprising a feeding revolver provided with at least three cells angularly spaced about the axis of rotation of the revolver, elongate conveying means defining at least two movable conveyor surfaces each to convey an individual succession of block-like articles towards at least two of the cells, when those cells are situated at a charging station, displacing means selectably operable to displace an individual block-like article of each respective succession into a respective one of said at least two cells at the charging station, and means to rotate the revolver stepwise to bring each cell successively to an output station to be situated adjacent such packing station.

Conveniently, the feeding revolver is provided with an odd number of cells at equal successive angular spacings, and preferably the odd number is seven.

The displacing means include a plurality of transfer cells, each pivotable between a first position adjacent a respective one of the conveyor surfaces and a second position in alignment with a respective one of the cells at the charging station.

BRIEF DESCRIPTION OF DRAWINGS

Embodiments of the present invention will now be more particular described with reference to the accompanying drawings, in which:

FIG. 2 to 26 show various stages in the folding of the container blank to make the finished container, FIG. 4 showing a plurality of second container blanks, each to be attached at one end of a respective first container blank;

FIGS. 34 to 37 show enlarged detail views corresponding to FIG. 32 with part of the folding means in different positions;

FIG. 38 shows a side elevation view of a mandrel forming part of the apparatus;

FIG. 39 shows an end elevation, partly in section, of the mandrel shown in FIG. 38;

DESCRIPTION OF PREFERRED EMBODIMENTS

Figure 2:
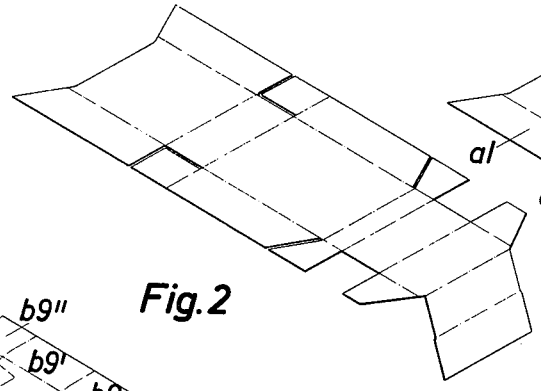

Referring to the drawings, and particularly to FIGS. 1 to 27, the manner of folding a container blank to form a carton or container for a cigarette block will be described.

Figure 1:
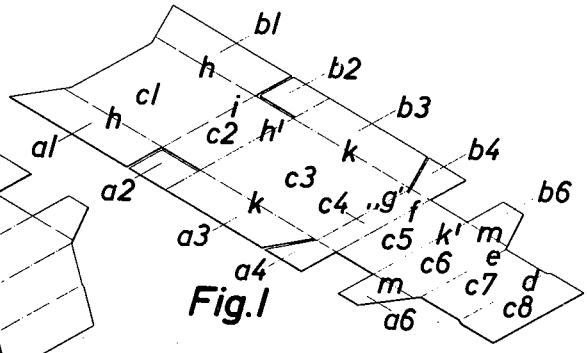
FIG. 1 shows a container blank for use in making a container to receive a cigarette block.

FIG. 1 shows a first container blank lying flat, and in FIG. 1 the individual segments of the container blank have been designated by individual reference characters. Furthermore, individual fold lines have also been designated by reference letters. Normally, the foldlines are defined by scores or other markings on the container blank, but this is not absolutely necessary, the lines being defined in any event by associated geometric features of the container blank.

The left hand end section of the container blank shown in FIG. 1 comprises a central portion $c_1$ and two opposite lateral portions $a_1$ and $b_1$ connected with the central portion $c_1$ by fold lines $h$, $h$ respectively. To the right of the left hand end section is a central portion $c_2$ between opposite lateral portion $a_2$ and $b_2$, the portion $c_2$ being separated from the portions $a_2$ and $b_2$, the portion $c_2$ being separated from the portions $a_2$ and $b_2$ in each case by a cut in the container blank. Similarly, the portions $b_1$ and $b_2$, and also $a_1$ and $a_2$, are separated from one another by a cut at right angles to the first mentioned cuts. The portions $a_2$ and $b_2$ are connected to further lateral portions $a_3$ and $b_3$ respectively by two end portions of a fold line $h'$ extending perpendicularly to the above mentioned fold lines $h$, $h$; the central portion of the single fold line $h'$ connecting the central portion $c_2$ to a further central portion $c_3$ having on either side thereof respectively a lateral portion $a_3$ and $b_3$. The right hand termination of the portion $a_3$ is bounded by a line of cut extending obliquely from the right hand end of the central portion $c_3$, so that the portion $b_3$ is of trapezoidal shape, the shorter parallel side of the trapezium being remote from the central portion $c_3$. This is also true of the portion $a_3$. The next central portion to the right is portion $c_4$ having lateral portions $a_4$ and $b_4$ at respective opposite ends the portions $a_4$ and $b_4$ also being trapezoidal in shape and terminating to the right in lines perpendicular to the longitudinal axis of the elongate container blank, such lines forming respective opposite continuations of a fold line $f$. The fold line $g$ at the right hand end of the central portion $c_3$ is of particularly great significance, this fold line forming the boundary between the lid and the main body of the container when folding, to be described below, has been completed.

Central portion $c_5$ to the right of portion $c_4$ has no corresponding lateral portions. Fold line $k'$ connects portion $c_5$ to portion $c_6$, which has associated lateral portions $a_6$ and $b_6$ at respective opposite ends.

There now follow, towards the right in FIG. 1, central portion $c_7$ and central portion $c_8$, a fold line $e$ being situated between portions $c_6$ and $c_7$, and a fold line $b$ between portions $c_7$ and $c_8$.

Figure 3:
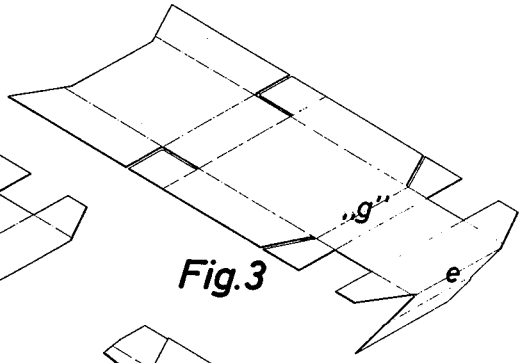

The folding procedure will now be explained with reference to FIGS. 2 to 27. The container blank is shown in FIG. 2 after partially making the first fold along fold line $e$, the portions $c_7$ and $c_8$ being deflected downwardly in FIG. 2 about the fold line $c$. FIG. 3 shows the blank portion after deflecting portions $c_7$ and $c_8$ through 90°.

Figure 4:
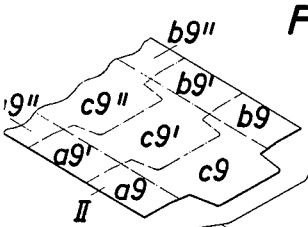
Figure 4:
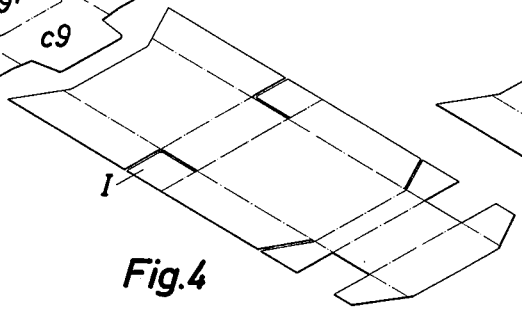

In FIG. 4 portions $c_7$ and $c_8$ have been folded back through 180° into contact with portions $c_6$ and $c_5$ respectively. FIG. 4 also shows a plurality of second container blanks shown at II, the first container blank being shown at I.

Each successive container blank II is stamped out from the card, and consists of the portions $a_9$, $c_9$ and $b_9$ as shown in FIG. 4. Only one second container blank is utilized in each case with each first container blank.

Figure 5:
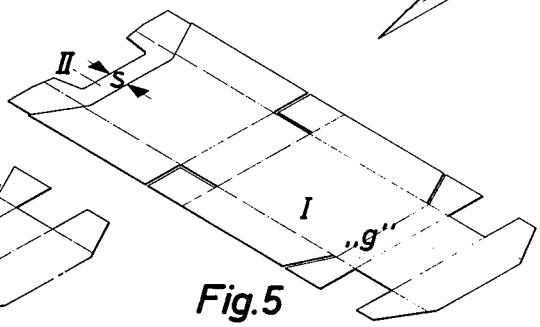

After severance of one second container blank from the card, the second container blank is overlapped with the first container blank, the second container blank being underneath the first, as shown in FIG. 5. This Figure also shows a spacing $s$ in the longitudinal direction of the first container blank between the innermost extremity of a recess at the left hand end of the second container blank and the left hand termination of the central portion $c_1$ of the first container blank. The fold line $g$ is clearly shown in FIG. 5.

The first or second container blank may be provided with a quantity of adhesive material before being overlapped with the other container blank, so that the two container blanks are fixed together in the position shown in FIG. 5.

Figure 6:
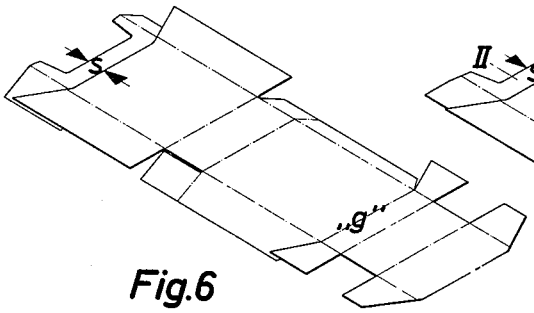
Figure 7:
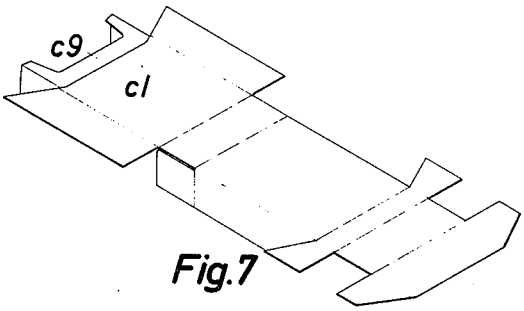

FIG. 6 shows the container blank assembly made up of the two container blanks, after the lateral portions $a_9$ and $b_9$, and $a_3$ and $b_3$, together with portions $a_2$ and $b_2$, have been deflected downwardly through an acute angle in each case. In FIG. 7, this acute angle has been increased to make it equal to 90°.

Figure 8:
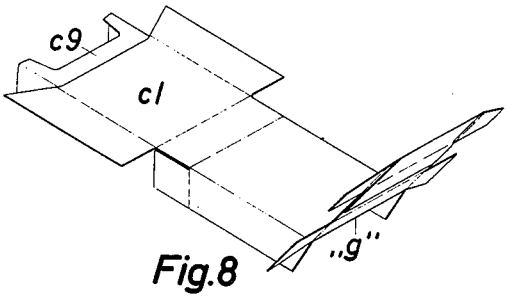

In FIG. 8, the commencement of a fold along fold line $g$ has taken place.

FIG. 9 shows that the portion of the first container blank to the right of the fold line $g$ in FIG. 6 (the second longitudinal portion) has been bent back over the remainder of the first container blank, (the first longitudinal portion) and in FIG. 10 complete superposition of the central portions $c_4$, $c_5$ and $c_6$ on the central portion $c_3$ has taken place.

FIG. 11 shows the lateral portions $a_2$ and $b_2$ having been deflected inwardly, and FIG. 12 shows those portions deflected through 90°. In FIG. 13 a fold along the line $h'$ has been commenced, and in FIG. 14 the entire portion of the container blank to the left of fold line $h$ in FIG. 13 has been folded downwardly through 90°.

Figure 17:
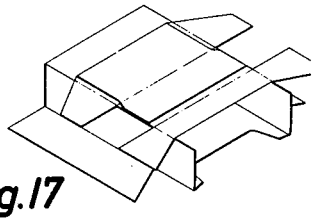

In FIG. 15, folding along fold line $i$ has begun, to bring the central portion $c_1$ towards the central portion $c_3$. FIG. 16 shows the continuation of this fold. These two central portions in a finished container form the front and back walls of the container. In FIG. 17, the central portion $c_1$ has been brought into parallelism with the central portion $c_3$, and the lateral portions $a_9$ and $b_9$ have been folded inside the lateral portions $a_3$ and $b_3$, respectively.

Figure 19:
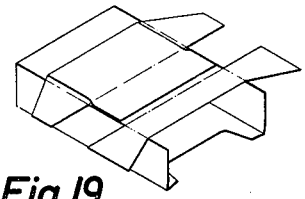
Figure 18:
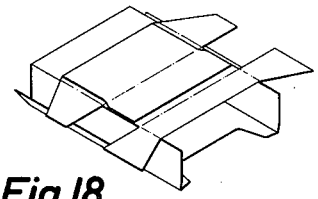

FIG. 18 shows the container blank after commencement of the operation of folding the lateral portions $a_1$ and $b_1$ upwardly, and in FIG. 19 the lateral portions $a_1$ and $b_1$ have been pressed radially inwardly against the external surface of the lateral portions $a_3$ and $b_3$, respectively.

Figure 22:
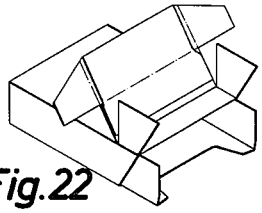
Figure 21:
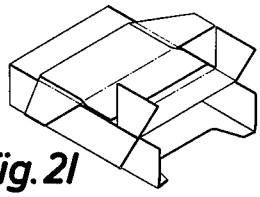
Figure 20:
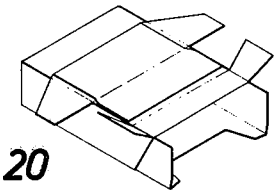
Figure 23:
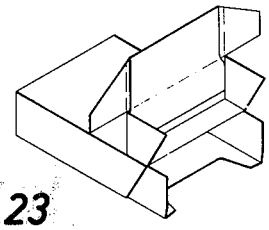

FIG. 20 shows the lateral portions $a_4$ and $b_4$ bent upwardly, and in FIG. 21 those lateral portions have been folded through 90°. The next fold takes place along fold line $f$, as shown in FIG. 22, the central portion $c_4$ remaining pressed against the central portion $c_3$. In FIG. 23, the central portions $c_5$ and $c_6$ have been folded together about the fold line $f$ through 90° to rise perpendicularly from the central portion $c_3$.

Figure 25:
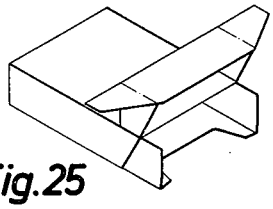
Figure 24:
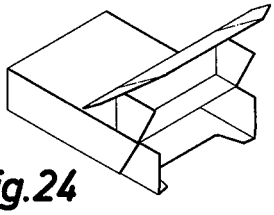

In FIG. 24, the central portion $c_6$ has been partially folded clockwise about the fold line $k'$, to bring the lateral portions $a_6$ and $b_6$ towards the lateral portions $a_4$ and $b_4$ respectively. In FIG. 25, central portion $c_6$ makes an angle of 90° with central portion $c_5$ and therefore rests parallel to central portion $c_3$. At the same time as central portion $c_6$ is folded through 90° relative to central portion $c_5$ about fold line $k'$, portion $c_7$ is also folded relative to portion $c_8$ about fold line $d$.

Figure 27:
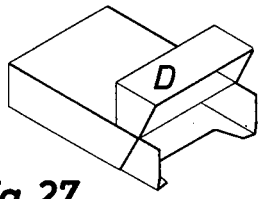
FIG. 27 shows a finished container with the lid of the container in the open position.
Figure 26:
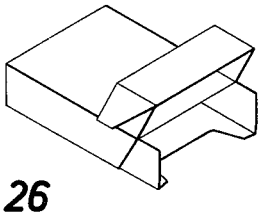

FIG. 26 shows the lateral portions $a_6$ and $b_6$ partially folded downwardly relative to central portion $c_6$ about fold lines $m$, $m$ in FIG. 1, and in FIG. 27 the two folds about the fold lines $m$, $m$ in FIG. 1, and in FIG. 27 the two folds about the fold lines $m$, $m$ have taken place through 90°, the inward facing surfaces of the lateral portions $a_6$ and $b_6$ being pressed radially inwardly against the outward facing surfaces of lateral portions $a_4$ and $b_4$ respectively. Before the folding operations begin, lateral portions $a_3$, $a_4$, $b_3$ and $b_4$ are each provided with a single strip of adhesive material, as also is central portion $c_6$. One method of application of the adhesive material will be described in greater detail below. The adhesive is applied in the flat condition of the container blank, for example as shown in FIG. 1.

All the folding operations take place on a shaping mandrel, which may for example be one of twelve situated on a revolver. The construction of the mandrels, which have the form of double mandrels, will be described more fully below, with particular reference to the manner in which a main portion of the mandrel is employed during the folding of the main body of the container, while the lid of the container is folded on a projecting further portion of the mandrel.

When the container has been completed it it pushed into for example an eight-cell further revolver, the lid being held open until a cigarette block (which may if desired be wrapped in an inner wrapper) has been inserted into the container. The eight-cell revolver thus acts as a filling revolver. The lid is then closed and the finished package is ejected from the revolver.

Fuller details of the steps taking place after the folding steps will be given below.

The folding about the fold or score line *g* is of particular significance, and this particular folding step is not employed with known machines. Such known machines operate in such a way that the line situated at a position corresponding to the line *g* remains unfolded.

It is also of significance to note from FIG. 16, that the lateral portions $a_9$ and $b_9$, as indicated above, are pushed inwardly of the lateral portions $a_3$ and $b_3$ respectively.

The apparatus for carrying out the method described above will now be described with reference to FIGS. 29 to 43, and initially the various folding means will be described with reference to particular to FIGS. 29 to 39.

Figure 29:
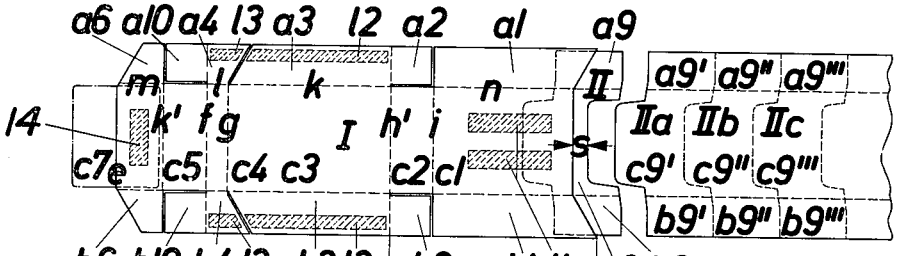
FIG. 29 shows a plan view of a container blank according to a modified embodiment.

FIG. 29 shows a container blank assembly made up from a first container blank on the left and a second container blank fixed to the first blank by adhesive material. The container blank on the left in FIG. 29 differs from that shown in FIG. 1, insofar as in the blank shown in FIG. 29 the central portion $c_8$ is omitted and additional lateral portions $a_{10}$ and $b_{10}$ are provided to be separated by cuts in the material of the blank from portions $a_6$ and $c_5$, and $b_6$ and $c_5$ respectively, the fold line *f* being extended in both directions to run along one edge of each of the lateral portions $a_{10}$ and $b_{10}$. Quantities of adhesive material are shown at $l_1$, $l_2$, $l_3$ and $l_4$ in FIG. 29.

Figure 30:
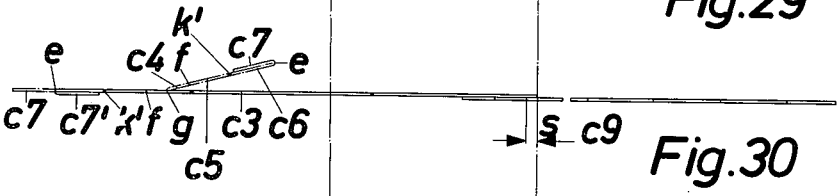
FIG. 30 shows in side elevation the container blank shown in FIG. 29.

In FIG. 30, there is shown in solid lines the container blank assembly with the central portion $c_7$ folded under at $c_7$, and in chain-dotted lines the same container blank assembly after the making of a fold through an obtuse angle about the fold line *g*.

Figure 31:
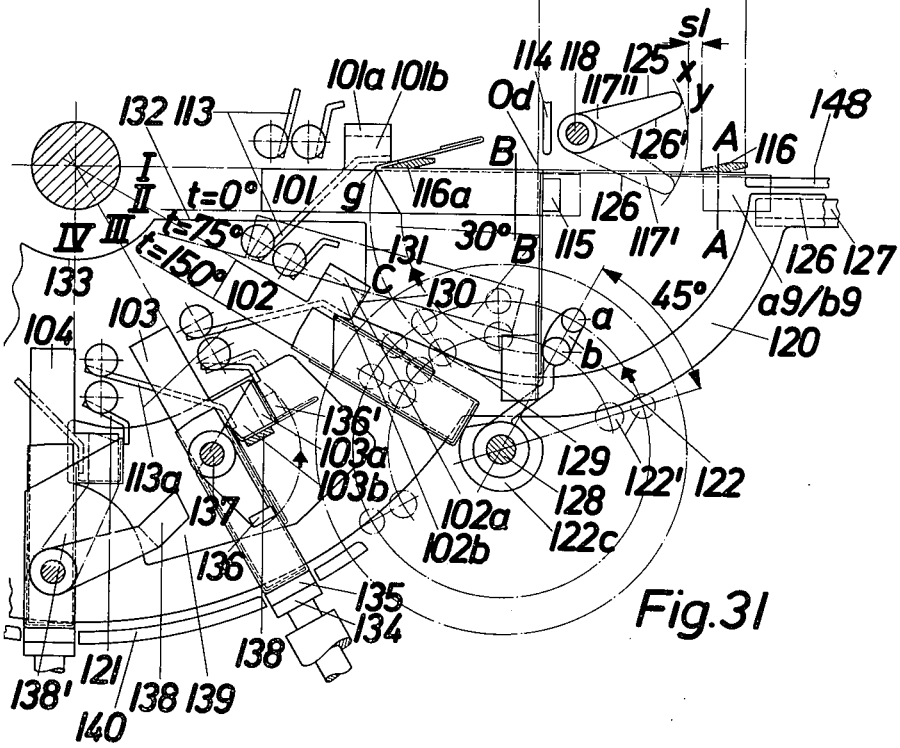
FIG. 31 shows schematically part of a folder revolver of one embodiment of apparatus according to the invention.

FIG. 31 shows substantially one quarter of the folder revolver having twelve mandrels, successive ones of which are equally angularly spaced about the periphery of the revolver, four such mandrels being shown at 101, 102 103 and 104 respectively. Individual stations for each successive mandrel are shown at I, II, III and IV respectively in FIG. 31, projecting such stations being provided.

The construction of each mandrel is shown in FIGS. 38 and 39. Each mandrel has a main or body portion, for example 101 in FIG. 38 and a projecting or lid-portion 101*a, b* projecting from the main body portion. A recess 101*c* is defined between the main portion and the projecting portion, and an aperture 101*b* is provided through the projecting portion as shown in FIG. 39 to permit retaining means in the form of a gripper 113 to pass through the aperture 101*b* to retain a blank in position in the recess 101*c*, as will be described below.

A folding lever 117 is shown in FIG. 31, having opposite edges 125 and 117′ and pivotable about a shaft 118. A reciprocatory folding member is shown at 114. The folding member 114 and the folding lever 117 form part of first folding means. A holding means in the form of a slider 116 is provided to be reciprocatable between a right hand position shown at 116 in FIG. 31 and a left hand position shown at 116*a*. Stationary guide means of curved shape are shown at 120 and are provided on guide surfaces of a housing, between which the mandrels pass during stepwise rotation of the revolver.

A rotary folding member 122*a, b* is pivotable about a shaft 128, and has an eccentric portion 122*c* arranged to act as a locating and pressing device for the radially outer edge portion of a partially folded container blank on a mandrel. Folding surfaces 129, 130 and 131 and a terminal surface 132 of the housing are shown in FIG. 31, which also shows a further gripper 121 associated with each mandrel to grip the lid portion of a container after folding around the projecting portion of the mandrel. Two lateral folders are shown at 115, and these are movable inwardly of the container. Pressing devices 134 provided with rubber members 135 are disposed at each station III to XII of the folder revolver, to take over the function of the eccentric portion 122*c* once a mandrel has left station II of the revolver.

Further folding devices are shown at 136 and 138, and these are pivotable into position 136′ and 138′ respectively. The radially inner surface of the housing is shown at 133. An opening 139 is provided in the housing to permit of the operation of the folding devices 136 and 138. Members 126 and 127 are connected to the curved stationary guide 120 on either side to retain lateral portions of the container blank during intermediate stages of the folding operations. Elements 126′ are similar to elements 126, and are provided on the opposite side of the housing.

Figure 33:
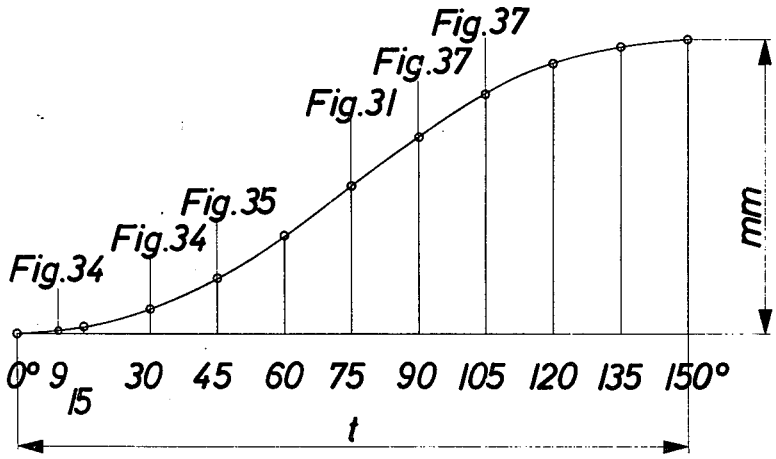
FIG. 33 shows graphically the progress of the folder revolver during part of its switching cycle.
Figure 34:
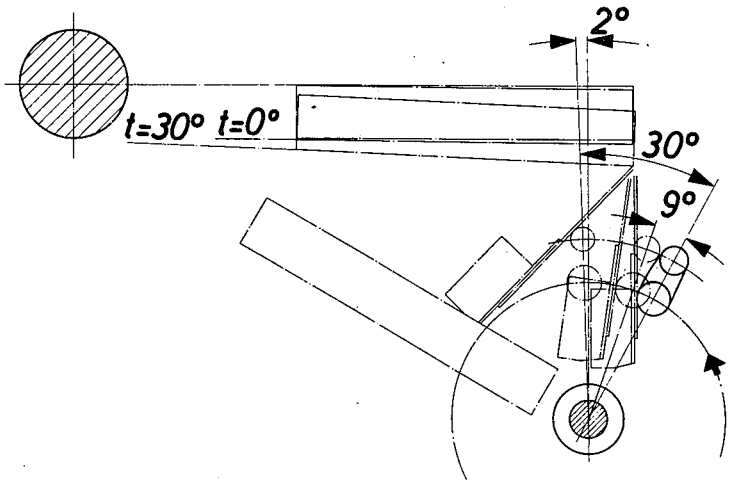
Figure 40:
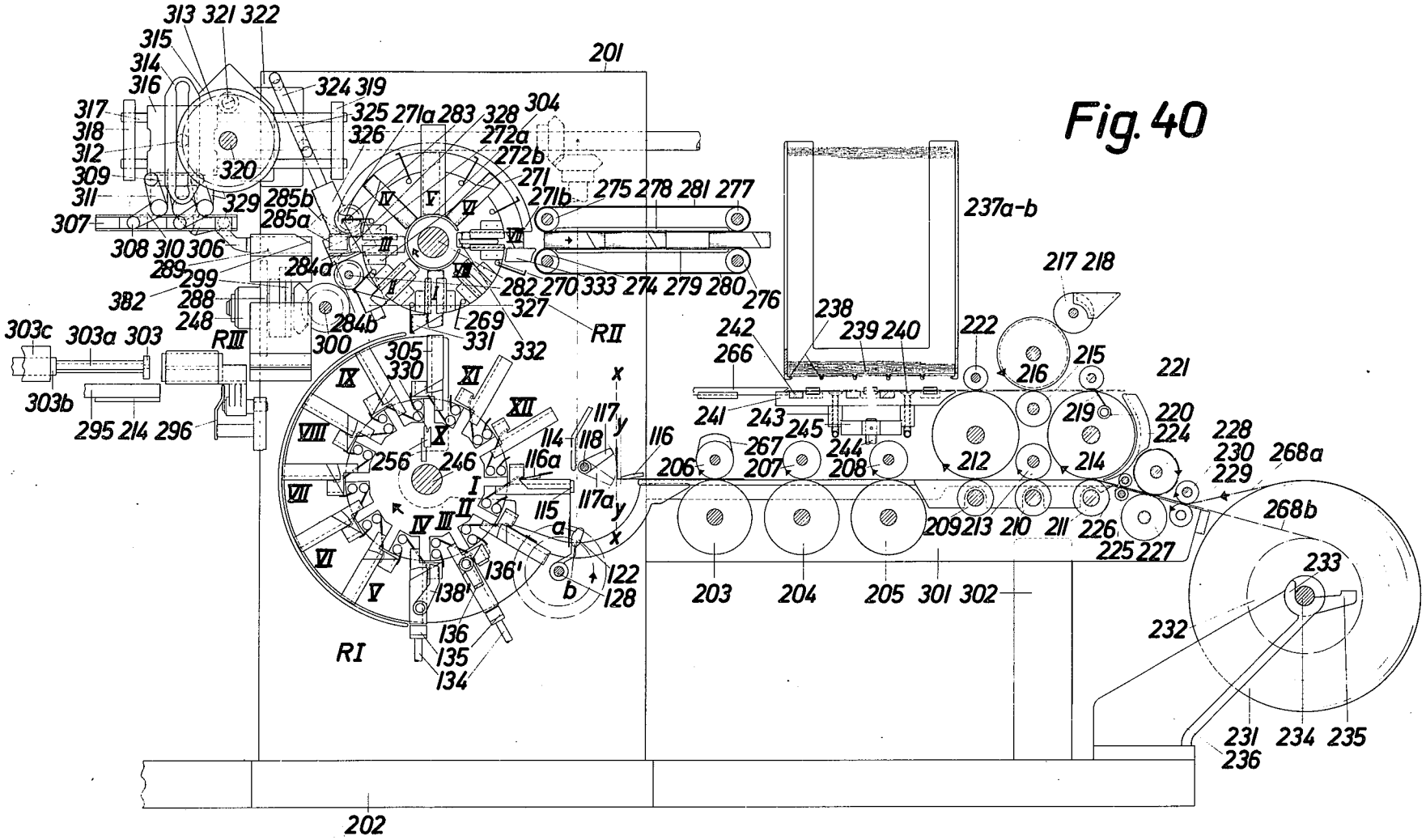
FIG. 40 shows schematically the folder revolver, part of which is shown in FIG. 31, in combination with other parts of the apparatus.
Figure 42:
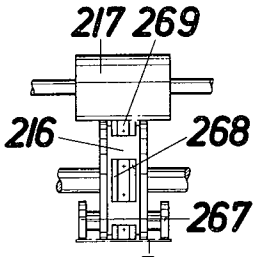
FIG. 42 shows a detail view of part of the apparatus shown in FIG. 40.

FIGS. 32 and 34 to 37 show different stages in the combined movement of the revolver and the rotary folding member 122. These different stages will be explained further below. FIG. 33 shows graphically the inter-relationship of the displacement of the revolver (vertical axis) and the time (horizontal axis). However, the time is expressed in terms of the angle of rotation of the folder 122, the origin of the graph in FIG. 33 (shown at $t=0$) corresponding to the position of the folder 122 shown in solid lines in FIG. 31. FIGS. 32 and 34 to 37 are labelled to show the associated position on the graph shown in FIG. 33.

By the folding of the container blank along the fold line *g*, a folding edge *m′* is produced, a shown for example in FIG. 12. This edge *m′* is the part of the container blank which, together with mutually adjacent parts of the first and second longitudinal portions of the container blank on either side of the edge *m′*, is introduced into the recess 101*c*.

Each gripper 113 is mounted on a main body or dish of the revolver, on which also the revolver mandrels are secured. The dish is shown at 254 in FIG. 41. The further grippers 121 are also mounted on the revolver dish.

The adhesive material deposits shown in FIG. 29 may be applied by known means during the conveying of the container blank on the part 118 shown in FIG. 31 towards the revolver, transport rollers (not shown in FIG. 31) if desired being used. In the preferred embodiment, the adhesive is applied while the container blank is flat.

The slider 116 shown in FIG. 31 is substantially wedge-shaped and may be driven for its reciprocating motion for example by displacement means in the form of a crank drive arrangement. The lever 117 may be a double lever or correspondingly wide, and may be driven for example by a cam drive arrangement.

The devices 116 and 117 serve to produce the fold along the line $g$ through 180°. During this step, the portions $c_4$, $c_5$, $c_6$, $c_7$ (and $c_8$ when provided) are moved as one piece and brought back against the remainder of the container blank.

The operation of the apparatus described above will now be set out.

Figure 31A:
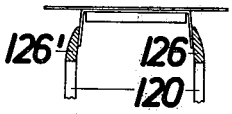
FIG. 31*a* and 31*b* show enlarged detail sectional views of part of the apparatus shown in FIG. 31.
Figure 31B:
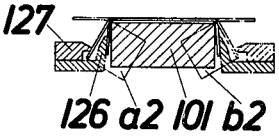
Figure 32:
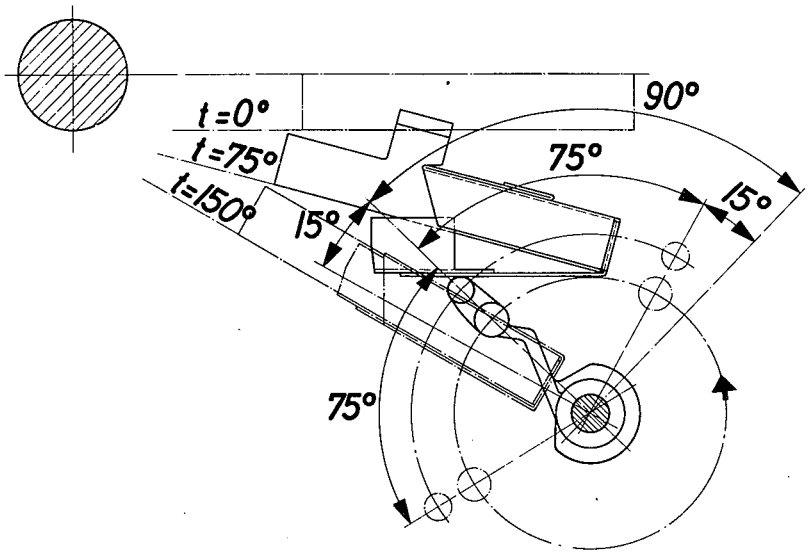
FIG. 32 shows schematically and to an enlarged scale part of the apparatus shown in FIG. 31.

A container blank assembly having the first and second blanks shown in FIG. 29 held together by adhesive material is fed, with the central portion $c_7$ already folded under the central portion $c_6$, from right to left in FIG. 31 along the member 148. The container blank is pre-shaped by deflecting means comprising rollers (not shown in FIG. 31) on its path over the element 148, the pre-shaping being maintained by means of guide pieces 126, 126' and 127 shown in FIGS. 31*a* and 31*b*. The guide pieces 126 and 126' are provided in each case with a tongue connected to circular arcuate guide member 120. The purpose of the pre-shaping is to ensure that the flaps $a_9$ and $b_9$ are held at a certain inclination to the horizontal to enable them to be fitted from this inclined position easily under the lateral portions $a_3$ and $b_3$ respectively. Thus, the flaps $a_9$ and $b_9$ may if desired be pushed fully inwardly to be folded through 180°.

The slider 116 pushes the container blank towards the left in FIG. 31, so that the fold line $g$ comes into the region between the lines $x$—$x$ and $y$—$y$. The lever 117 then moves from position 117, the parts $c_4$, $c_5$ and $c_6$ of the container blank having run up the lever rear surface 125 forming a slope. The surface 117' thus moves to the position shown at 117''. During this part of the folding operation, the slider 116 acts as a holding means to hold down the first longitudinal portion of the container blank. The above described pivoting of lever 117 causes the portions $c_4$, $c_5$ and $c_6$ to be swung upwardly, and the forward edge of the slider 116 serves to determine the exact position of folding.

During the forward movement, the parts $c_4$, $c_5$ and $c_6$ are folded over as a whole through 180° against the surface 117' of the lever 117. This folding takes place along fold line $g$, which is then pressed by the slider 116 into the wedge-shaped recess 101*c* of the mandrel 101. The gripper 113 then holds the container blank fast in this recess.

Folding through a full 180° angle into close contact is not absolutely necessary in all cases. A smaller angle may be used if the or each mandrel is shaped accordingly. It is, however, desirable, that when the portions of the blank adjacent the fold line $g$ have been introduced into the recess in the mandrel, the central portion $c_3$ should define a plane which is not intersected by any part of the second longitudinal portion of the blank.

After the anchoring of the container blank by the recess 101*c*, (see line C—C in FIG. 31), the lateral folders 115 move inwardly and fold the lateral portions $a_2$ and $b_2$ obliquely round the right hand end of the mandrel 101. The portions $a_2$ and $b_2$ may be deflected initially by for example about 5° to 10°.

While the lateral folders 115 move out again, the upper folder 114 moves downwardly and folds the entire part $c_2$, $c_1$ together with $c_9$ and $a_1$, $b_1$, $a_9$ and $b_9$ downwardly through about 90°. The middle point of the circular arcuate guide part which holds the flaps $a_9$ and $b_9$ in their position, is the point $O_d$ shown in FIG. 31. The point $O_d$ lies at the top right hand corner of the main portion of the mandrel 101.

When the vertical position of the right hand part of the container blank has been reached, the revolver begins to execute a step of rotation. At this moment, the rotary folder 122, which has a particular shape and is rotable on the shaft 128, has reached the position shown in solid lines in FIG. 31, i.e. it has rotated forwardly by 45° from its original or neutral position shown at 122'.

Stages in the combined movement of the revolver and folder 122 are represented in FIG. 34 to 37. In FIG. 36, as shown, the flaps $a_9$ and $b_9$ are situated inwardly of the portions $a_3$ and $b_3$ respectively, and are secured in such a position.

Further folding operations are performed by edges of a stationary part 129 connected to the guide part 120.

When the revolver has rotated through 30°, the mandrel 101 has reached the position of station II of the revolver arrangement. At that time, the edges of part 129 have put the container blank smoothly against the mandrel, now shown at 102 in FIG. 31, and the edges of part 129, which can if desired be constructed to be resilient, press the portions, $c_1$, $a_1$ and $b_1$ securly against the mandrel 102. In the case of portions $a_1$ and $b_1$, the portions $a_3$ and $b_3$ lie between the respective portions and the mandrel. The rotary folder 122 has been swung through 150°, and has swung out of the range of the mandrels. Part 122*c* of the rotary folder 122 is somewhat wider than the width of the package along fold line $g$, and forms a segment which is effective to press the floor $c_2$ of the package along its entire width against the radially outer end of the mandrel 102, so that a cornered package is produced also at the floor region.

At the further stations III and IV, pressing devices 134 provided with rubber parts 135 came into action during the whole of the time of standstill of the mandrels (i.e. of the revolver), and again press the floor $c_2$ flat.

The next operation of the production of the lid or flap of the flip-top container (sometimes referred to as hinge-lid container). This takes place as follows. The portions $a_6$ and $b_6$, $a_{10}$ and $b_{10}$, and $a_4$ and $b_4$ were previously also folded over by the edges of part 129. At station III, lateral sliders act on the portions $a_{10}$ and $b_{10}$ and during inward movement fold over these portions on to the mandrel part 101*b*, 101*a*. Thereupon, two laterally situated levers 136, which are secured on rotable and displaceable shafts 137, which are mounted in stationary bearings, are moved. These act as lateral rotary folders. The levers 136 are moved from the position shown at 136 in FIG. 31 to the position shown at 136', and during this movement they engage under the portions $a_6$ and $b_6$ freed again by the openings in the housing, raise these portions up and are further pushed inwardly under portions $c_6$, $c_7$. The lever 136 then raise the portions $c_6$ and $c_7$ to apply these portions over the projecting portion of the mandrel. At the same time, portion $c_3$ is also applied against the projecting portion of the mandrel. After this, portions $c_6$ and $c_7$ are securely clamped by the gripper 121 on the projecting portion 101*a* of the mandrel.

The revolver now executes another step of rotary motion, so that the mandrel 103 previously at station III now passes through station IV. The lateral levers 138 now pivot from the position at 138 in FIG. 31 to the position shown at 138', and fold the portions $a_6$ and $b_6$ hard against the portions $a_4$ and $b_4$ respectively.

The entire folding operation is now complete. If it is necessary to hold the portions $a_6$ and $b_6$ against portions $a_4$ and $b_4$ for a longer period, then this can take place by means of rigid or resilient lateral sheets.

At station X, the finished folded container is pushed out of the folder revolver in an upward direction into a cell of a further revolver which is provided for the insertion of a cigarette block into the container.

A terminating arcurate guide 140 is shown in FIG. 31.

Figure 43:
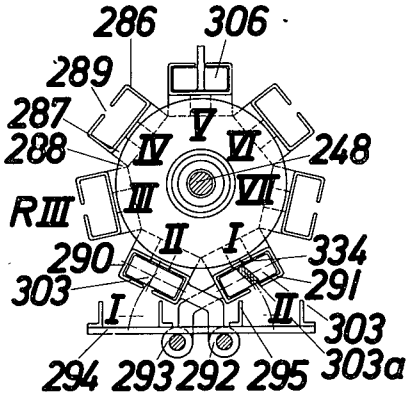
FIG. 43 shows an enlarged view in elevation of the feeding revolver and auxiliary components shown in the left hand side in FIG. 40.

FIGS. 43 show schematically the folder revolver, shown at RI, the further revolver RII and a third revolver (a feeding revolver) RIII, which is described below. The revolvers RII and RIII are provided for the purpose of inserting a cigarette block into each container procuded on the revolver RI, and are provided with eight and seven cells respectively.

Figure 41:
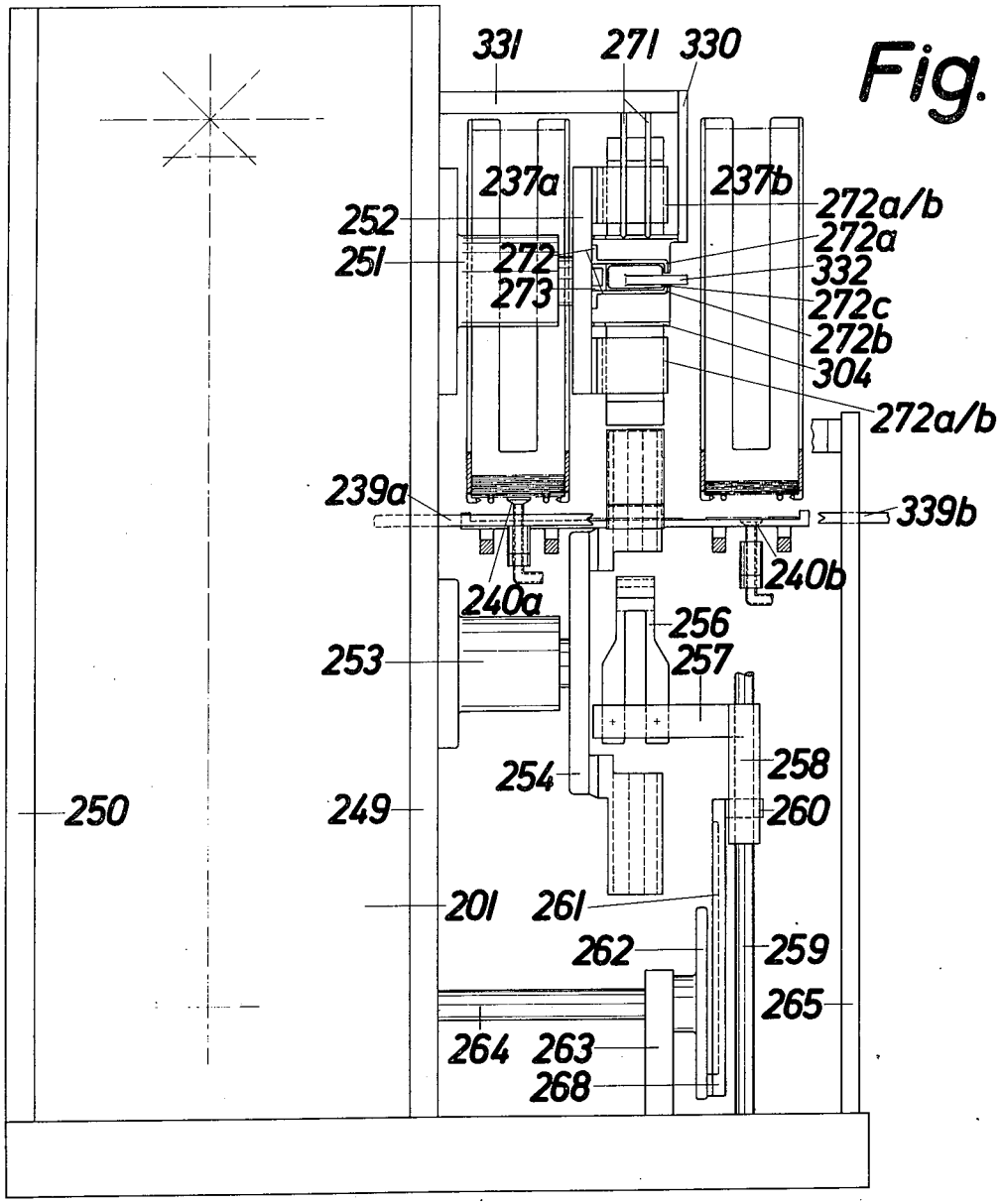
FIG. 41 shows part of the apparatus of FIG. 40, in side elevation.

The main body of the machine as a rectangular box 201 with a plate 249 in front of it (on the right in FIG. 41), and a cover 250 behind it (on the left in FIG. 41). The cover is constructed as a swingable door.

Control arrangements are provided in the box 201 for the revolvers RI, RII and RIII. Such control arrangements may be of known kind, for example cam and roller arrangements, and are not shown in the drawings. There are shown however bearings 251, 253 and 248, situated on the plate 249, and the revolver dishes 252, 254 and 255 mounted on shafts, which are themselves mounted in the bearings. In the manner described above, the mandrels 101 and 112 are secured on the main revolver dish 254. The folding means described above are likewise shown in FIG. 40.

Two storage magazines 237*a* and 237*b* for flat, unfolded first container blanks I are shown on the right in FIG. 41, and one half of the output of such blanks is taken from each storage magazine. Suction devices are provided to remove the blanks from the magazines, e.g. alternatively, with each magazine there being associated two parallel suctions heads 240, which are secured on a respective common shackle 245 in two holders 243. The shakles 245 are secured in each case to a push rod 244, which can be moved up and down by cam operated actuating means, in stationary guides (not shown).

The use of two storage magazines and suction feeding devices can be important in reducing for example any difficulties associated with flexible connecting tubes provided to transmit suction to the feeding devices, since the two feeding devices operate at only half the speed which would be necessary if only one feeding device were provided.

The container blanks I are held in the storage magazines by small hooks 238, and the suction devices are arranged to deposit the successive blanks withdrawn from the magazines on a system shown at 241 and 242. A slider 266 pushes the blanks forward a small distance, until they are taken up by a pair of rollers 222 and 212, to be transported further. The further advance of the first container blanks then takes place by means of rollers 215 and 216 and subsequently by means of rollers 211 and 214. Reference numeral 216 designates a narrow double roller with two driving rings and devices such as applicator segments attached thereto for depositing quantities of adhesive material. These devices are supplied with adhesive material from a supply roller 217 fed by a reservoir 218. This may take place in known manner. The applicator segments then transfer the adhesive material in the required pattern as shown at $l_1$, $l_2$, $l_3$ and $l_4$ in FIG. 29, onto the container blank as it passes between the rollers 215 and 216. A gripper cylinder is shown at 214, and two grippers are shown at 219, which are secured rotably on a shaft 220. The grippers 219 are lifted by cam pressure, and by spring tension they press against the gripper cylinder. The springs are not shown. These grippers are arranged to grip for example the portions $a_6$ and $b_6$ of the blank. During the following travel of the blank, the latter is conveyed downwardly around the circumference of the cylinder. The portion $c_7$ strikes against the upper surface of a stationary guide segment 224. During the further travel downwardly, the portion $c_7$ is thus bent over and placed against the portion $c_6$, to be retained there by the quantity of adhesive material $L_4$. Having arrived at the bottom of the cylinder 214, the container blank then travels in the reverse direction, (i.e. from right to left in FIG. 40), driven by rollers 214 and 211, 213 and 210, 212 and 209, 208 and 205, 207 and 204, and 206 and 203. The roller 206 possesses two segments 267, which are arranged to fold over the lateral portions $a_3$ and $b_3$, $a_2$ and $b_2$ downwardly through an angle up to for example 60°. The feeding of the container blank assembly on to the mandrel 101 then starts, and the folding operations take place as above described.

Rollers 225 and 226, 227 and 228, 229 and 230 serve to withdraw a a second container blank II from a supply station and to so apply the blank II to the blank I as to create the spacing *s* shown in FIG. 5. The pair of rollers 227 and 228 together constitute a rotating stamping mechanism, for example of known kind, which stamps out a succession of second container blanks II from a strip of cardboard 268*a*, *b*. The strip moves along the path 268*a* from a large reel 231 or along the path 268*b* from a small reel 232, depending for example upon whether the reel is a fresh one or is about to expire. The reel is formed by a bobbin situated on a shaft 234, which is mounted in a part 235 of a fixed bearing block 236. A pair of rollers 229, 230 are provided to withdraw the strip from the bobbin.

The rollers 225 and 226 transport the stamped out second container blank II below the first container blank I to enable the two blanks to be secured together by the adhesive material $L_1$ with the aid of the rollers 211 and 214.

The action of the folding means including the lever 117 has already been described. If desired, the adhesive material may be for example a hot melt adhesive material. If desired, hot melt adhesive material can be reactivated several times.

At station X of the folder revolver, folding operations of the blank assembly have been completed and the container is pushed vertically up by a slider 256, which is actuated by crank plate 262, a pull rod 261, linkages 260 and 268, a carriage 258 and a stationary rod 259, and a holder 257. The slider 256 pushes the container upwards into the cell at station I of the cell revolver RII. The slider 256 is driven on the rod by a crank movement device, and slides through grooves 305 in the mandrals 101 to 112, as well as through the apertures in the projecting mandrel portions, and includes an overshoot stroke portion in the bottom position to synchronise the movement of the slider timewise in a precise manner, so that the movable components have moved out of the region of the mandrels 101 and 112 before the folder revolver starts to rotate. In this manner, the revolver RI can rotate without hindrance.

Figure 28:
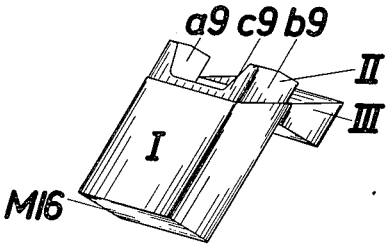
FIG. 28 shows the container of FIG. 27, in a different perspective view.

The revolver RII is provided with for example eight cells 272*a*, *b* with slots 272*c*, secured to the revolver plate 252 by straps 272. Parts 273 limit the inward extent of the cells. An upper groove in the slider 256 is so shaped, that the flap or lid 351 of the finished container (FIG. 28) which is open and to be pushed out upwardly cannot move towards the closed position.

When the container has reached the cell at station I of revolver RII, the lid 351 is gripped by gripper 269 until the container reaches station III of the revolver RII. This then permits the insertion of a cigarette block 382 by pushing member 306. During passage from station III to station IV, the lid is closed by stationary members 271, and in particular by one or more tongues 271*a* provided thereon.

At station IV, the lid 351 is completely closed and the container has already been filled to form a package. The package reaches station VII of revolver RII, from which it is ejected by means of an ejector 332 which passes through the cell slot 272*c*. The package is then further transported by continously moving belts 280 and 281, which run over rollers 274, 275 and 276, 277. The rollers 274 and 275 or the rollers 276 and 277 may be driven. Rails 333 and tongues 271*b* serve to guide the package during transfer to between the belts.

If desired, between station V and station VI a banding device can be fitted, which secures the closure of the package, i.e. of the lid 351, by applying a sealing strip, revenue label or other similar element. The device is not shown and may be of any suitable known kind.

The production of the cigarette block may take place in known manner on two parallel tracks, which run on a path 214, 295 represented only by its end. These tracks move with a speed equal to only half that which would be required with a single track, utilising a principle comparable with that shown in German patent specification 1,183,427 (FIG. 5) or U.K. patent specification 923,009 (FIGS. 1, 2 and 3). In the case of these patent specifications however the cigarette path is one of track only, while in the present case two tracks are provided and reverse situation applies, in that at the bottom two packages are fed simultaneously one from each track into a respective cell of the feeding revolver RIII, while at the top of the revolver one block is ejected. An odd number of cells is expedient on the feeding revolver RIII, so that the two bottom cells are disposed symetrically about a vertical axis, as shown in FIG. 43. In that Figure, seven cells are shown on the feeding revolver. In this case, each stepwise movement of the feeding revolver amounts to an angle of displacement of (360°/7), i.e. one-seventh of a complete revolution or about 51½°. During each stepwise motion of the feeding revolver, a filled cell arrives at the top, while filling of the cells at the bottom takes place only after each alternate stepwise movement, when two empty cells are present at the bottom. These are then filled simultenuously. The filling procedure takes place as follows, explained with reference to FIG. 40 and 43. The block tracks are designated by I and II. These may be of known kind and may be operated in known manner by chain transport drive means for the blocks, for example as shown in U.K. patent specification 789,590. Transport hooks (not shown) provided on the blocks track can swing back, as described in U.K. patent specification 789,590, and bring two blocks at a time into swivellable transfer cells 290 and 291, when these are situated in their bottom positions. When the hooks have swung back, the cells 290 and 291 swing upwardly into their top position at a charging station, shown in chain-dotted lines in FIG. 43, exactly in alignment with the revolver cells at stations I and II (revolver RIII). Displacing means in the form of two rectilinear sliders 303 push the blocks out of the cells 290 and 291 into the opposite empty revolver cells at station I and II of the revolver RIII. When this is taking place, all cells at station I to V of the revolver RIII are filled, and the block in the cell at station V of revolver RIII is pushed simultaneously into the cell at station III of revolver RII. Before the cells at stations I and II of the revolver RIII are emptied into the revolver RII at a packing station, the revolver RIII makes two portions of stepwise rotation. Then the filling of the revolver cells at stations I and II of the revolver RIII takes place again.

The above procedure for feeding the cigarette blocks can be used with machines other than the packaging machine described, and thus has general applicability.

A suitable means may be provided for the actuation of the sliders 306 and 332.

The sliders 303 stand obliquely and have oblique push rods 303*a*, so that the pivotable cells 290 and 291 moveable about the pivot points 292 and 293 respectively and which have slots 334 in their upper walls, can move downwardly, while the sliders 303 are situated forwardly and no longer in the region of the cells 290 and 291. The sliders 303 can be driven by a crank drive (not shown) if desired, uitilising 180° forward and 180° reverse stroke portions, one stroke being 360°. After two strokes of the main machine, there then takes place a single stroke of the sliders 303. The rod 303*a* is connected to a guide 303*b* mounted to slide in a stationary bearing 303*c*. Reference numeral 296 designates a stationay block abutment guide, which is secured on the housing plate 249 by means of supports 297 and 298.

I claim:

1. A method of producing a container from a foldable container blank having a fold line at the boundary between a first longitudinal portion of said blank and a second longitudinal portion of said blank, the method comprising:

a. the initial step of folding said blank at said fold line to bring mutually adjacent surface portions of said first portion and of said second portion respectively into mutually facing relationship; and b. the step of gripping said mutually adjacent surface portions in said mutually facing relationship whilst carrying out the further steps subsequent to initial step of folding said first portion to form exclusively from said first portion a main body of said container, and folding said second portion to form a lid of said container while said lid remains hingedly connected with said main body at said fold line.

2. Apparatus for producing a container provided with a lid from an elongate blank of foldable material, the apparatus comprising, in combination:

first folding means to fold said blank at a fold line to bring mutually adjacent surface portions of a first portion of said blank and of a second portion of said blank respectively into mutually facing relationship;

gripping means to grip said mutually adjacent surface portions in said mutually facing relationship;

second folding means to fold said first portion to form exclusively from said first portion the main body of said container during the operation of said gripping means; and third folding means to fold said second portion to form the lid of said container during the operation of said gripping means.

3. Apparatus as defined in claim 2, comprising a mandrel to support said blank during the operation of said second and third folding means, said mandrel comprising a main portion arranged to co-operate with said second folding means, and a projecting portion, which projects from said main portion and which is arranged to co-operate with said third folding means, said projecting portion defining with said main portion a recess to receive parts adjacent said fold line of said first and of said second portion of said blank after operation of said first folding means and being provided with an aperture therethrough, said gripping means extending through said aperture to grip said adjacent parts of said blank in said recess.

4. Apparatus as defined in claim 3, whrein said first folding means comprise a lever arranged in a first position thereof to be engaged by said second portion of said blank and then to move to a second position to fold said blank at said fold line, holding means being provided to hold said first portion of said blank in contact with a support during said movement of said lever.

5. Apparatus as defined in claim 4 comprising displacement means to displace said holding means in a direction towards said projecting portion after said movement of said lever and thereby to cause said adjacent parts of said first and second portions to be introduced into said recess.

6. Apparatus as defined in claim 3, wherein said second folding means include deflecting means to deflect opposite lateral extremities of said first portion of said blank in parallel directions perpendicular to the plane of said blank.

7. Apparatus as defined in claim 3, wherein said second folding means include a folder arranged to co-operate with said mandrel to fold said first portion of said blank along a line perpendicular to the length direction of said blank, whereby after the operation of said folder said two parts of said first portion on respective sides of said perpendicular line are inclined at 90° to one another.

8. Apparatus as defined in claim 3, wherein a plurality of such mandrels are angularly spaced from one another on a folder revolver, the recess of each said mandrel being open in a direction radial fo said revolver, an individual gripping means being adapted to extend through said aperture of each respective said projecting portion, said revolver being selectably actuatable to execute successive angular displacements.

9. Apparatus as defined in claim 8, wherein twelve mandrels are provided on said revolver at equal successive angular spacings.

10. Apparatus as defined in claim 8, wherein said second folding means include two spaced guide surfaces of a housing, in which said revolver is rotatably mounted; whereby during said successive angular displacements successive ones of said mandrels pass between said guide surfaces.

11. Apparatus as defined in claim 10, wherein said second folding means include a folding member mounted to be rotatable about an axis substantially parallel to the axis of rotation of said revolver, the rotation of said folding member being effected synchronously.

12. Apparatus as defined in claim 8, wherein said third folding means include two folding levers mounted to be pivotable about an axis substantially parallel to the axis of rotation of said revolver, said folding levers being spaced along their axis of pivoting and being displaceable parallel to that axis.

13. Apparatus as defined in claim 3, comprising further gripping means to grip a part of said second portion of said blank in contact with said projecting portion, said part being remote from said adjacent parts.

14. Apparatus as defined in claim 3, comprising two storage magazines each to receive a plurality of container blanks, and feeding means to feed said container blank from a selected one of said storage magazines towards one said mandrel.

15. Apparatus as defined in claim 8, comprising a feeding revolver arranged to feed an individual block-like article towards each respective said container successively produced on said folder revolver, said feeding revolver comprising a plurality of cells spaced about the periphery thereof each to receive one said block-like article, said apparatus further comprising displacing means selectably operable to displace two said block-like articles each individually into a respective one of two cells of said feeding revolver, means to rotate said feeding revolver stepwise to bring said cells individually and successively to a feeding station, means selectably operable to bring said containers individually and successively to said feeding station, and means selectably operable to transfer said block-like article in said cell at said feeding station into said container at said feeding station.

16. Apparatus as defined in claim 15, wherein said feeding revolver is provided with seven cells at equal successive angular spacings.

17. Apparatus as defined in claim 15 wherein said means to bring said containers to said feeding station comprise a further revolver provided with cells each to receive an individual one of said containers and means to transfer said containers individually from said mandrels to a respective cell of said further revolver.

18. Apparatus as defined in claim 17, wherein said further revolver is provided with eight cells at equal successive angular spacings.

19. Apparatus as defined in claim 15, wherein said means to displace two said block-like articles comprise two storage cells each pivotable into a position in alignment with respective one of said two cells on said feeding revolver, and slidable means to push said two block-like articles into said two cells.

* * * * *